US005846069A

United States Patent [19]

Sher

[11] Patent Number: 5,846,069

[45] Date of Patent: Dec. 8, 1998

[54] SAFETY LIGHTER WITH WHEEL HOOD

[75] Inventor: Tak Chi Sher, North Point, Hong Kong

[73] Assignees: Polycity Industrial Limited; Tak Fi International (Holdings) Limited, both of Quarry Bay, Hong Kong

[21] Appl. No.: 700,244

[22] Filed: Aug. 20, 1996

[51] Int. Cl.[6] ..... F23D 11/36

[52] U.S. Cl. ..... 431/153; 431/151; 431/277; 431/273

[58] Field of Search ..... 431/153, 151, 431/277, 273

[56] References Cited

U.S. PATENT DOCUMENTS

| | | | |
|---|---|---|---|
| 3,328,980 | 7/1967 | Reim | 431/153 |
| 3,938,943 | 2/1976 | Malamoud | 431/153 X |
| 5,074,781 | 12/1991 | Fujita . | |
| 5,092,764 | 3/1992 | McDonough et al. . | |
| 5,145,358 | 9/1992 | Shike et al. . | |
| 5,165,885 | 11/1992 | Iwahori . | |
| 5,184,948 | 2/1993 | Iwahori . | |
| 5,186,618 | 2/1993 | Shike et al. . | |
| 5,197,870 | 3/1993 | Yang . | |
| 5,213,493 | 5/1993 | Iwahori . | |
| 5,213,495 | 5/1993 | Pan . | |
| 5,215,458 | 6/1993 | Cirami . | |
| 5,224,854 | 7/1993 | Ansquer . | |
| 5,236,351 | 8/1993 | Tien | 431/153 X |
| 5,271,731 | 12/1993 | Hsin-Chung . | |
| 5,334,011 | 8/1994 | Frigiere . | |
| 5,421,720 | 6/1995 | Sher . | |
| 5,435,719 | 7/1995 | McDonough et al. . | |
| 5,460,516 | 10/1995 | Sher | 431/153 X |
| 5,462,432 | 10/1995 | Kim . | |
| 5,538,417 | 7/1996 | Chan . | |

FOREIGN PATENT DOCUMENTS

| | | | |
|---|---|---|---|
| 291956 | 11/1988 | European Pat. Off. | 431/153 |
| 296281 | 12/1988 | European Pat. Off. . | |

*Primary Examiner*—Larry Jones
*Attorney, Agent, or Firm*—Ladas & Parry

[57] ABSTRACT

A lighter including a lighter body containing fuel which is released through a nozzle. An actuating lever is placed on a mounting frame which is disposed on top of the lighter body. Activating the actuating lever causes fuel to flow through the nozzle. A striker rotatably mounted on the mounting frame is engaged to a piece of flint wherein rotating the striker against the piece of flint causes a spark to be generated, which ignites the fuel and causes a flame. A rotatable wheel hood having a safety position and an activation position is placed over the striker whereby placing the rotatable wheel hood in the safety position prevents the user from rotating the striker and causing a spark to be generated. Placing the wheel hood in the activation position allows the user to rotate the striker to generate a spark.

15 Claims, 4 Drawing Sheets

SAFETY LIGHTER WITH WHEEL HOOD

FIELD OF THE INVENTION

This invention relates to the field of lighters, such as cigarette lighters.

BACKGROUND OF THE INVENTION

Modern butane lighters have become very popular. One of the reasons for their popularity is that the height of the flame produced by the lighter can be varied over a wide range by varying the amount of fuel allowed to be ejected from the lighter. The very feature which makes such lighters attractive to the users also makes such lighters dangerous if they are accidentally ignited. When the lighter produces a flame in an uncontrolled circumstance, particularly when the lighter is set on its high setting, materials (such as curtains, clothing, hair) may accidentally be lit on fire. Also modern butane lighters suffer from the potential that the lever which actuates the lighter's nozzle will accidentally be depressed, thereby causing an unintended ejection of fuel, and therefore loss of fuel stored within the lighter body.

The two essentials of igniting a flame in a lighter are the ejection of gas and source of ignition. The source of ignition can be achieved by rotating the striker wheel so that it strikes the flint stone. A flame is lighted when gas is ejected from the gas nozzle at the same time.

Previous attempts to solve this problem have involved modification of the actuating lever, such as shown in U.S. Pat. No. 5,421,720 to applicant, which is hereby incorporated by reference. While this attempt has proved successful, further improvements are needed.

The concept of the design of the present invention is to control the source of ignition so that the lighter can only be ignited if certain conditions are met. The method of controlling the source of ignition is to hinder the rotation of the striker wheel especially by children in order to prevent it from striking the flint stone to give out spark.

SUMMARY OF THE INVENTION

Accordingly, it is an advantage of the present invention to have a lighter with a safety mechanism.

Another advantage of the invention is to provide a safety mechanism rotatably mounted over the striker to prevent a spark from being generated.

Yet another advantage of this invention is to provide a safety mechanism which is automatically engaged.

These and other advantages of the present invention are carried out in a lighter. The lighter including a lighter body having an interior portion in which fuel is stored. A nozzle is disposed in a communicating relationship with the interior of the lighter body so that fuel may flow from the lighter body through the nozzle. A mounting frame is disposed on top of the lighter body. The mounting frame includes a stop point. A nozzle actuating lever is engaged with the nozzle so that activating the nozzle actuating lever allows fuel to pass from the interior through the nozzle. A striker is rotatably mounted on the mounting frame. Rotation of the striker causes the striker to strike a piece of flint and generate a spark which ignites the fuel which has passed through the nozzle. A wheel hood, having a safety position and an activation position, is also rotatably mounted on the mounting frame. Placement of the wheel hood is the safety position prevents the user from rotating the striker and generating a spark.

DETAILED DESCRIPTION OF THE PREFERRED EMBODIMENT

Figure 1:
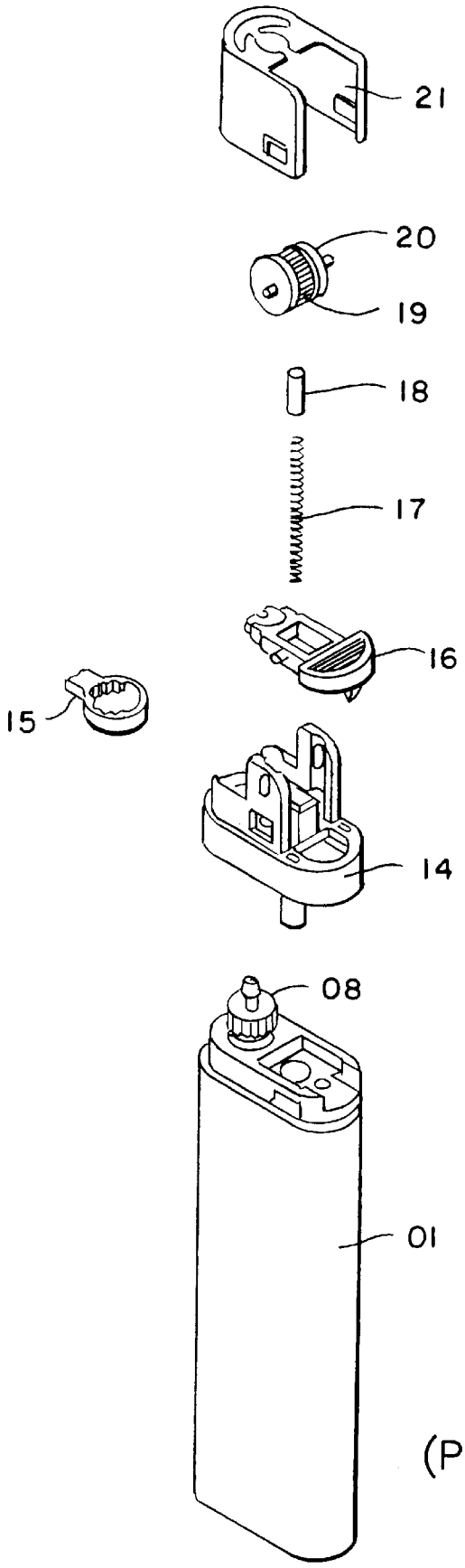
FIG. 1 (PRIOR ART)
FIG. 1 is an exploded view of a prior art disposable lighter.

The preferred embodiment of the subject invention is illustrated in the attached drawings which are referred to herein. The same reference numeral will be used to identify identical elements throughout the drawings.

FIG. 1 illustrates components of a prior art disposable lighter commonly mounted on a lighter body 01 in which the fuel is contained. Such components include nozzle 08, mounting frame 14, flame adjustment wheel 15, actuating lever 16, the igniter comprising flint spring 17, flint 18, striker wheel 19, striker wheel edge 20, and windshield 21. Striker wheel 19 may be coalesced with striker wheel edge 20 to form an unitary striking mechanism. To operate the lighter, striker wheel edge 20 is rotated by the user to rotate striker wheel 19 to strike flint 18 to create a spark. Striker wheel edge 20 as fixed on striker wheel 19 touches flint stone 18 closely under the action of spring 17. The rear end of actuating lever 16 is pressed downward by the user virtually simultaneously with the striker wheel being actuated while the nozzle 08 is raised upward by the front end of the actuating lever 16, ejecting fuel to light a flame. The striker wheel 19 stops immediately after the lighting of a flame, while the ejection of gas and the flame are maintained during the period that the rear end of actuating lever 16 is being held down.

Figure 2:
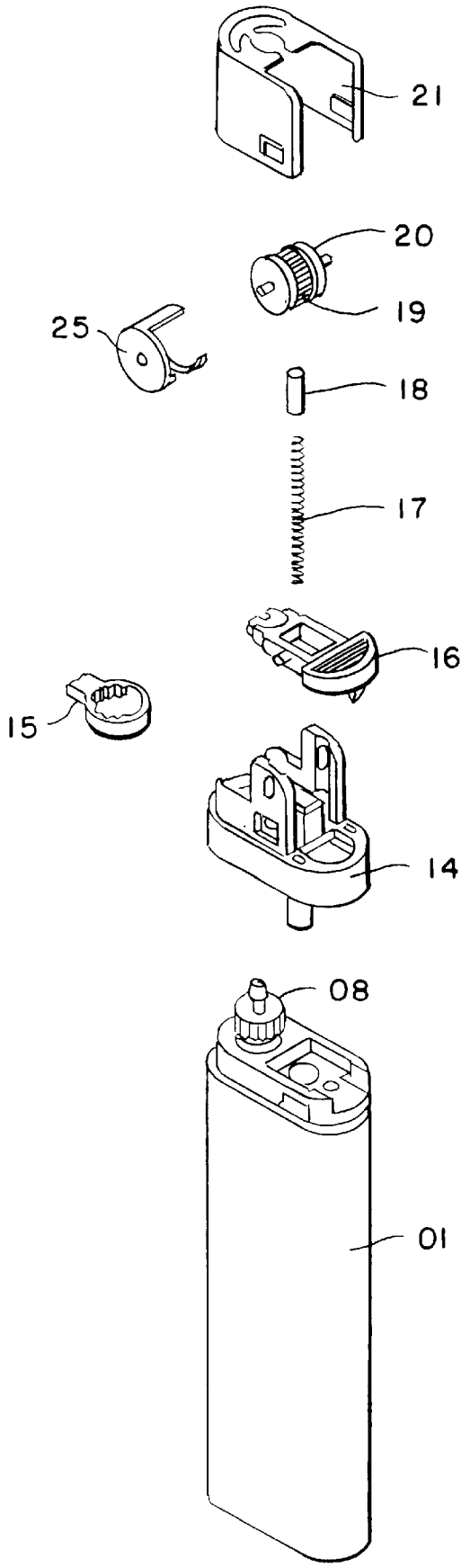
FIG. 2 is an exploded view of the safety lighter of the present invention.
Figure 3:
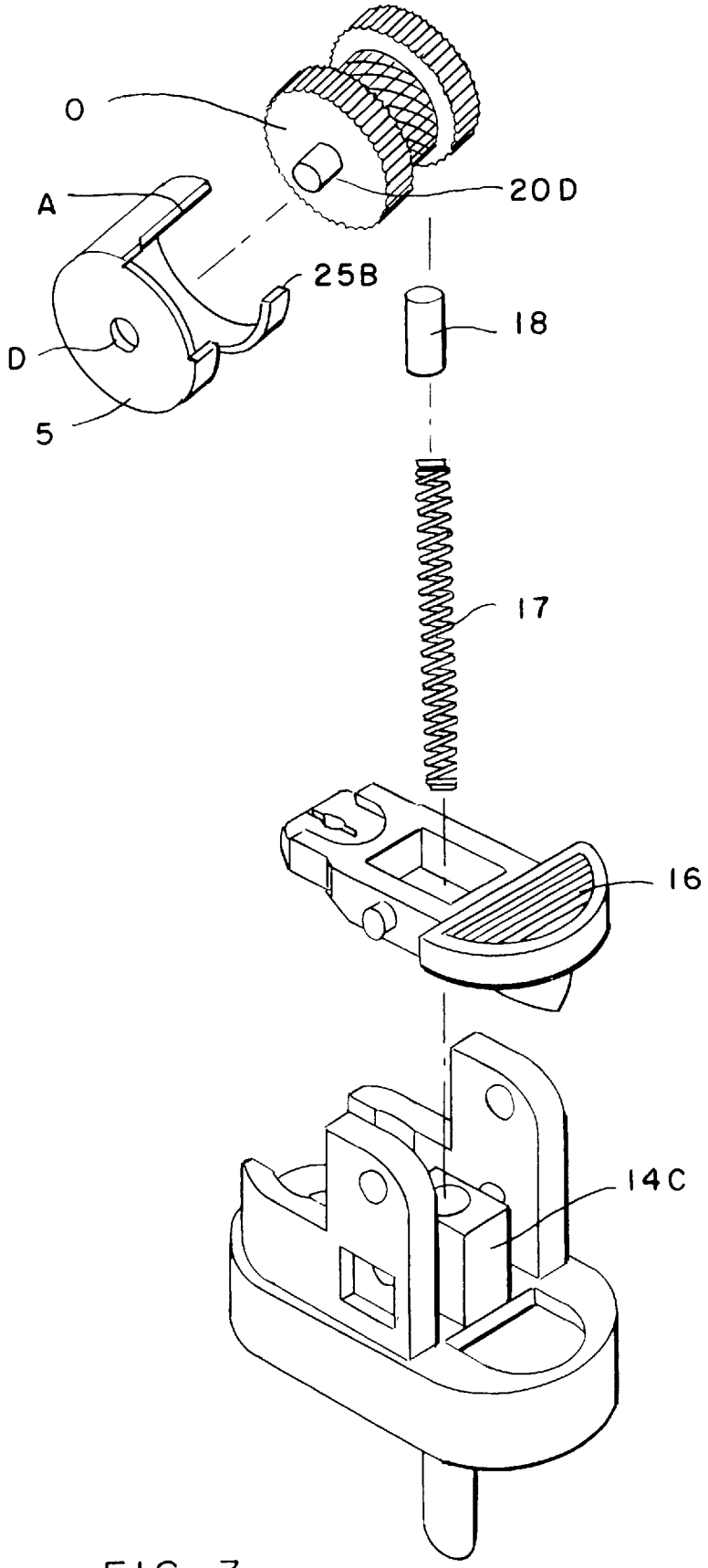
FIG. 3 is a perspective view of the components relating to the safety device of the present invention.

FIG. 2 shows the addition to an ordinary disposable lighter of the newly invented wheel hood 25 to control the rotation of the striker wheel edge 20 and striker wheel 19. This is different from ordinary lighters. A more detailed view can be seen in FIG. 3.

Figure 4:
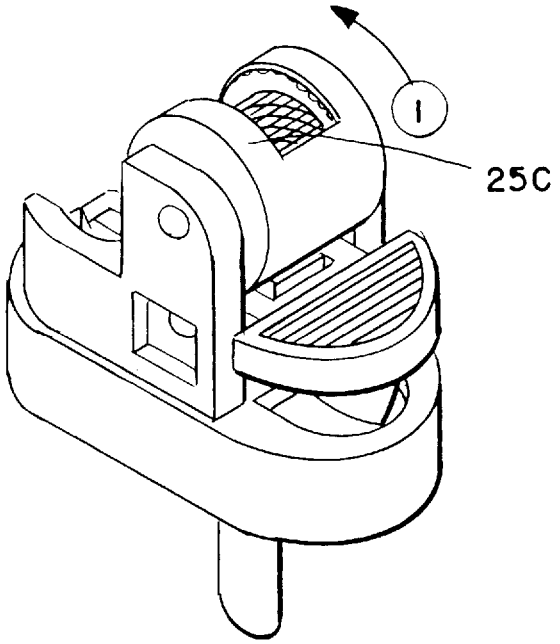
FIG. 4 is a schematic drawing of the safety device of the present invention in a safety position.

FIG. 4 shows the components forming the inventive aspects of present invention in the safety position. In this position, the striker wheel edge 20 cannot be rotated by the user and therefore the striker wheel cannot be rotated, preventing the creation of a spark. That is, when the stop edge 25A of wheel hood shield 25C is in touch with the stop point 14C of mounting frame 14 and cannot rotate in the clockwise direction any further, wheel hood shield 25C of wheel hood 25 covers the striker wheel edge 20 completely. At this time, striker wheel edge 20 cannot be rotated. Since striker wheel edge 20 cannot be rotated by the user, striker wheel 19 cannot strike flint 18 to create a spark.

Figure 5:
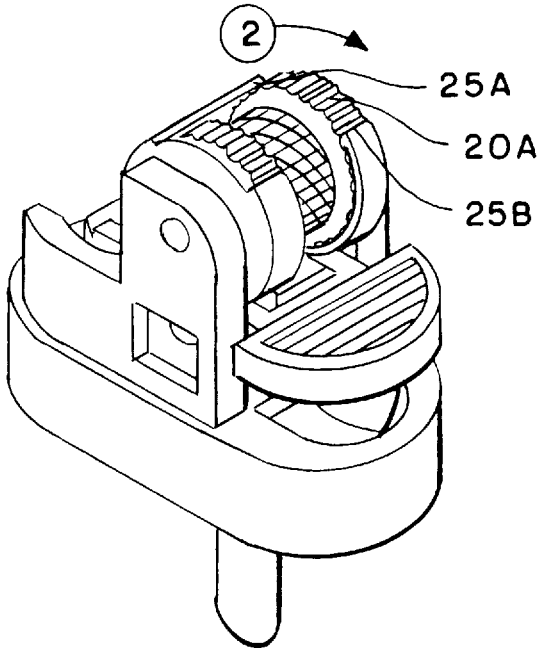
FIG. 5 is a schematic drawing of the safety device of the present invention in an operational state.

If ignition is required, the user can rotate wheel hood 25 in direction ① as shown in FIG. 4 until the wheel hood is in the position as shown in FIG. 5. Axle 20D of striker wheel edge 20 is in slot 25D of wheel hood 25. Since substantially no frictional force is exerted, wheel hood 25 is able to rotate freely.

FIG. 5 illustrates the state in which the safety device is released and the lighter may be used. In this position, the space between stop edges 25A and 25B of wheel hood shield 25C will expose the teeth 20A of striker wheel edge 20. Striker wheel edge 20 can be rotated in direction ② as indicated in FIG. 5.

When rotating the exposed teeth 20A of striker wheel edge 20 with a finger, stop edge 25B of wheel hood shield 25C also rotates in the same direction because of the simultaneous contact by the finger. Wheel hood 25 will rotate for a certain distance and stops until stop edge 25A of wheel shield 25C reaches stop point 14C of mounting frame 14. In this way, the lighter automatically returns to the safety position as shown in FIG. 4.

The present invention has been described above with reference to a preferred embodiment. However, those skilled in the art will recognize that changes and modifications may be made in this embodiment without departing from the scope of the present invention. Those skilled in the art will recognize that the various specific tasks and devices described herein in connection with this embodiment may be altered significantly without departing from the scope of the present invention. These and other changes and modifications which are obvious to those skilled in the art are intended to be within the scope of the present invention.

I claim:

1. A lighter comprising:

(a) a lighter body containing fuel in its interior;

(b) a nozzle disposed in communicating relationship with the lighter body's interior;

(c) a mounting frame disposed atop said lighter body, said mounting frame including a stop point;

(d) a nozzle actuating lever having a front end and a rear end, said front end engaged with said nozzle, said nozzle actuating level being pivotally mounted on said mounting frame so that depressing the rear end of said nozzle actuating level raises said front end and said nozzle and allows said fuel to pass from said interior of said lighter body through said nozzle;

(e) a striker rotatably mounted on said mounting frame, said striker comprising a striker wheel and a striker wheel edge;

(f) a piece of flint engagable with said striker wherein the rotation of said striker against said piece of flint causes said flint to produce a spark; and (g) a wheel hood rotatably mounted on said mounting frame and encircling said striker wheel, said wheel hood comprising a first stop edge extending across the width of said wheel hood, a second stop edge comprising a first and a second end with a gap between said first end and said second end, said gap being at least width of said stop point of said mounting frame, a space between said first stop edge and said second stop edge, and a shield wherein said shield will cover said striker wheel edge when said first stop edge is in communication with said stop point.

2. A lighter according to claim 1 wherein said wheel hood is rotatable around its axis so that said striker wheel edge is exposed by said space between the first and second stop edges.

3. A lighter according to claim 2 further comprising a windshield mounted on said mounting frame and partially surrounding said nozzle and said flint.

4. A gas light comprising:

(a) a lighter body containing fuel in its interior;

(b) a nozzle in fluid communication with the interior of said lighter body;

(c) an actuating lever for controlling a flow of fuel through said nozzle;

(d) a spark generating apparatus for generating a spark in response to operation thereof to ignite fuel which has flowed through said nozzle; and (e) a safety device having first and second positions, the safety device when its first position inhibiting a user from operating said spark generating apparatus and when it its said second position allowing the user to operate said spark generating apparatus, said safety device assuming said first position contemporaneously with the user operating said spark generating apparatus.

5. A lighter according to claim 4 wherein operating said spark generating device automatically moves said safety device from its second position to its first position.

6. The lighter according to claim 4 wherein said spark generating apparatus includes a striker wheel and wherein said safety device at least partially covers said striker wheel when in its first position thereby rendering said striker wheel inaccessible for rotation by the user when in said first position.

7. The lighter according to claim 6, wherein said striker wheel and said safety device both have a generally cylindrical configuration, said safety device being mounted for rotation relative to said striker wheel, said safety device having an opening therein which, in the second position allowing the user to rotate said striker wheel and in the first position inhibiting the user from rotating the striker wheel.

8. The lighter wheel according to claim 7, wherein said striker wheel operates against a flint stone to create a spark and wherein said safety device has a channel therein permitting the flint stone to contact said striker wheel.

9. A lighter comprising:

(a) a lighter body containing fuel in its interior;

(b) a nozzle disposed in communicating relationship with the lighter body's interior;

(c) a mounting frame disposed atop said lighter body, said mounting frame including a stop point;

(d) a nozzle actuating lever having a front end and a rear end, said front end engaged with said nozzle, said nozzle actuating level being pivotally mounted on said mounting frame so that depressing the rear end of said nozzle actuating level raises said front end and said nozzle and allows said fuel to pass from said interior of said lighter body through said nozzle;

(e) a striker rotatably mounted on said mounting frame, said striker comprising a striker wheel and a striker wheel edge;

(f) a piece of flint engagable with said striker wherein the rotation of said striker against said peice of flint causes said flint to produce a spark; and (g) a cylindrically shaped wheel hood rotatably mounted on said mounting frame and encircling said striker wheel, said wheel hood comprising (i) a first end, (ii) a second end comprising a hole, and (iii) a cylindrical wall portion having a solid portion, a void portion, and a partially solid and partially void portion, a first stop edge located at the intersection of said solid and void portions and a second stop edge located at the intersection of said void portion and said partially solid and partially void portion and a third stop edge located at the intersection of said solid portion and said partially solid and partially void portion.

10. A lighter according to claim 9 wherein said wheel hood is in a first position covering said striker wheel edge characterized in that said first stop edge is against said stop point.

11. A lighter according to claim 10 wherein said wheel hood is rotatable to a second position characterized in that said third stop edge is against said stop point and said striker wheel edge is exposed by the void portion of said cylindrical wall portion.

12. A lighter according to claim 11 wherein said wheel hood is functionally engaged with said striker wheel edge wherein rotation of said striker wheel edge causes said wheel hood to automatically travel from said second position to said first position.

13. The lighter according to claim 9 wherein said first end contains a circular void.

14. The lighter according to claim 13 wherein said striker wheel further comprises an axle, said axle rotatably mounted within said void of said first end.

15. The lighter according to claim 9 wherein said striker wheel edge comprises grooves.

* * * * *